US009272862B2

(12) United States Patent
Tateishi

(10) Patent No.: US 9,272,862 B2
(45) Date of Patent: Mar. 1, 2016

(54) SHEET FEEDING DEVICE AND IMAGE FORMING APPARATUS

(71) Applicant: CANON KABUSHIKI KAISHA, Tokyo (JP)

(72) Inventor: Satohisa Tateishi, Abiko-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/615,843

(22) Filed: Feb. 6, 2015

(65) Prior Publication Data

US 2015/0251863 A1 Sep. 10, 2015

(30) Foreign Application Priority Data

Mar. 7, 2014 (JP) ..... 2014-044645

(51) Int. Cl.
*B65H 3/06* (2006.01)
*B65H 7/20* (2006.01)

(52) U.S. Cl.
CPC ..... *B65H 3/0684* (2013.01); *B65H 3/0669* (2013.01); *B65H 7/20* (2013.01); *B65H 2403/51* (2013.01); *B65H 2403/512* (2013.01); *B65H 2403/514* (2013.01); *B65H 2513/10* (2013.01)

(58) Field of Classification Search
CPC ..... B65H 3/06; B65H 3/0615; B65H 3/0669; B65H 3/0684; B65H 7/00; B65H 7/02; B65H 7/14; B65H 7/20; B65H 9/004; B65H 9/006; B65H 2403/51; B65H 2403/512; B65H 2403/514; B65H 2513/20; B65H 2513/21; B65H 2513/212; B65H 2513/22; B65H 2513/222
See application file for complete search history.

(56) References Cited

U.S. PATENT DOCUMENTS

| | | | | |
|---|---|---|---|---|
| 4,319,740 | A * | 3/1982 | Ulseth | B65H 1/266 271/118 |
| 5,977,739 | A | 11/1999 | Ohsawa | |
| 7,549,629 | B2 | 6/2009 | Tateishi et al. | |
| 7,748,697 | B2 | 7/2010 | Fujita et al. | |
| 2010/0225053 | A1 | 9/2010 | Nakamura et al. | |
| 2013/0082435 | A1 * | 4/2013 | Colston | B65H 3/0816 271/18 |
| 2014/0084531 | A1 * | 3/2014 | Fukumoto | B65H 3/06 271/10.1 |
| 2014/0239573 | A1 * | 8/2014 | Akai | B65H 3/06 271/109 |
| 2015/0084269 | A1 * | 3/2015 | Tateishi | B65H 1/266 271/121 |
| 2015/0203307 | A1 * | 7/2015 | Tanaka | B65H 3/0684 271/117 |

FOREIGN PATENT DOCUMENTS

| | | | |
|---|---|---|---|
| EP | 2226278 | A2 | 9/2010 |
| JP | 2010202379 | A | 9/2010 |

* cited by examiner

*Primary Examiner* — Prasad Gokhale
(74) *Attorney, Agent, or Firm* — Fitzpatrick, Cella, Harper & Scinto

(57) ABSTRACT

When a sheet is determined to arrive at a registration roller, a motor is temporarily stopped and then, is rotated so as to return a cam to an initial position. When the motor is rotated, in a case where a relation between a rotation angle θ of the cam at the time of stopping the motor and a rotation angle γ of the cam according to the rotation of the motor in a time required for the motor until acceleration up to constant-speed rotation from a stopped state of the motor and until deceleration from the constant-speed rotation and stop after the deceleration is "θ<360−γ", the motor is rotated at a first speed by controlling acceleration/deceleration of the motor and, in a case where the relation is "θ>360−γ", the motor is rotated at a constant second speed lower than the first speed.

18 Claims, 9 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, and more particularly, to a configuration that drives a sheet feeding portion.

2. Description of the Related Art

A conventional image forming apparatus such as a printer, a copying machine, or a facsimile equipment includes a sheet feeding device that feeds a sheet set in a sheet stacking portion using a feed roller that is a sheet feeding portion and supplies the sheet to an image forming portion. In order to prevent duplicate feeding of feeding two or more sheets when a sheet is fed by the feed roller, this sheet feeding device includes a separation portion that separates sheets one by one.

As such a sheet feeding device, for example, there is a device that feeds sheets one by one by performing control of one rotation of a feed roller by using a toothed gear, a toothed gear abutting unit, a solenoid, and the like (see U.S. Patent Application Publication No. 2010/225053 A1). Sheets fed according to one rotation of the feed roller are separated one by one by a separation portion and then are delivered by the separation portion to a sheet conveying unit located on the downstream in the sheet feeding direction so as to be conveyed.

However, in a conventional sheet feeding device, there are cases where a feed roller configuring the sheet feeding roller or the separation portion slips. In such cases, the control of one rotation of the feed roller ends with a sheet not being in contact with the sheet conveying portion, and accordingly, a no-feed jam occurs. In order to prevent the occurrence of such a no-feed jam, the conveyance amount of the sheet may be increased. However, in order to increase the conveyance amount of the sheet according to the control of one rotation of the feed roller, it is necessary to increase the size of the toothed gear and the like, and thus, it is difficult to save the space and reduce the cost.

The present invention is devised in consideration of such a phenomenon, and it is desirable to provide a sheet feeding device and an image forming apparatus capable of saving the space and reducing the cost and capable of reliably feeding a sheet.

SUMMARY OF THE INVENTION

According to the present invention, there is provided a sheet feeding device including: a sheet stacking portion on which sheets are stacked; a sheet feeding portion which feeds the sheet with being abutted to an uppermost sheet stacked in the sheet stacking portion; a support member which supports the sheet feeding portion and is rotatable in a vertical direction; a cam which holds the sheet feeding portion at a standby position separated from the sheet by upwardly rotating the support member and moves the sheet feeding portion to a feeding position abutting the sheet by downwardly rotating the support member; a motor which rotates the cam; a first detection portion which detects that the cam is located at an initial position holding the sheet feeding portion at the standby position; a registration portion which is arranged on a downstream of the sheet feeding portion in a sheet feeding direction, abuts a downstream end of the sheet fed by the sheet feeding portion in the sheet feeding direction in a stopped state, and feeds the sheet by being rotated at predetermined timing; a drive transfer portion which is set such that the sheet fed by the sheet feeding portion at the feeding position arrives at the registration portion by lifting and lowering the sheet feeding portion between the standby position and the feeding position through in accordance with one rotation of the cam by the motor; a second detection portion which is disposed on an upstream the sheet feeding direction and detects that the sheet fed by the sheet feeding portion arrives at the registration portion; and a controller which temporarily stops the motor based on a signal from the second detection portion and thereafter rotates the motor such that the cam is returned to the initial position and, when the motor is rotated, in a case where a relation between a rotation angle $\theta$ of the cam at the time of stopping the motor and a rotation angle $\gamma$ of the cam according to the rotation of the motor in a time required for the motor until acceleration up to constant-speed rotation from a stopped state and until deceleration from the constant-speed rotation and stop after the deceleration is "$\theta<360-\gamma$", rotates the motor at a first speed by controlling acceleration/deceleration of the motor and then stops the motor based on a signal from the first detection portion and, in a case where the relation is "$\theta>360-\gamma$", rotates the motor at a constant second speed lower than the first speed and then stops the motor based on a signal from the first detection portion.

As in the present invention, when the motor is temporarily stopped and rotated so as to return the cam to the initial position, by controlling the rotation speed of the motor in accordance with the rotation angle of the cam at the time of stopping the motor, space saving and low cost can be achieved, and a sheet can be fed in a reliable manner.

Further features of the present invention will become apparent from the following description of exemplary embodiments with reference to the attached drawings.

DESCRIPTION OF THE EMBODIMENTS

Figure 1:
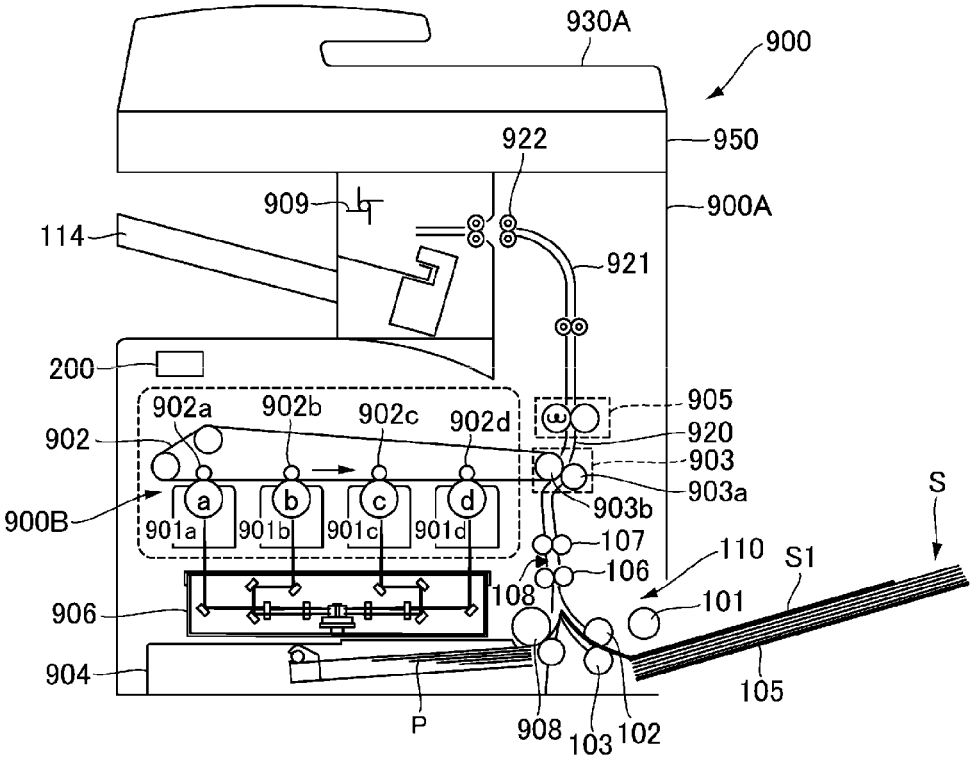
FIG. 1 is a diagram that illustrates the configuration of an image forming apparatus including a sheet feeding device according to a first embodiment of the present invention.

Hereinafter, embodiments for performing the present invention will be described in detail with reference to the drawings. FIG. 1 is a diagram that illustrates the configuration of an image forming apparatus including a sheet feeding device according to a first embodiment of the present invention. In FIG. 1, the image forming apparatus 900, an image forming apparatus main body 900A (hereinafter, referred to as an apparatus main body), and an image forming portion 900B that forms an image on a sheet are illustrated. In addition, an image reading apparatus 950 that is disposed in an upper part of the apparatus main body 900A and includes an original conveying apparatus 930A and a manual sheet feeding unit 110 that is disposed in one side part of the apparatus main body 900A and includes a manual tray 105 that can be manually driven are illustrated. Furthermore, a finisher 909 is a sheet processing apparatus arranged between the upper face of the apparatus main body 900A and the image reading apparatus 950.

Here, the image forming portion 900B includes: photosensitive drums a to d that form toner images of four colors including yellow, magenta, cyan, and black and an exposure apparatus 906 that forms an electrostatic latent image on the photosensitive drum by being irradiated with a laser beam based on image information. In addition, these photosensitive drums a to d are driven by a motor not illustrated in the figure, and, on the periphery of each thereof, a primary charger, a development device, and a transfer charger, which are not illustrated in the figure, are arranged, and these components are configured as portions as process cartridges 901*a* to 901*d*.

In addition, the image forming portion 900B includes: an intermediate transfer belt 902 that is driven to rotate in the direction of an arrow; a secondary transfer portion 903 that sequentially transfers a full-color image formed on the intermediate transfer belt 902 to a sheet P; and the like. By applying a transfer bias to the intermediate transfer belt 902 by using transfer chargers 902*a* to 902*d*, color toner images formed on the photosensitive drums are sequentially transferred to the intermediate transfer belt 902 in a multiple manner. Accordingly, a full-color image is formed on the intermediate transfer belt.

The secondary transfer portion 903 is configured by: a secondary transfer counter roller 903*b* that supports the intermediate transfer belt 902; and a secondary transfer roller 903*a* that abuts the secondary transfer counter roller 903*b* through the intermediate transfer belt 902. In addition, in FIG. 1, a registration roller 107 that is a registration portion, a sheet feeding cassette 904, and a pickup roller 908 that feeds a sheet P housed in the sheet feeding cassette 904 are illustrated. Furthermore, a controller 200 is responsible for controlling the apparatus main body 900A and the finisher 909. In addition, a pull-out roller 106 conveys a sheet fed from the manual sheet feeding unit 110 to the image forming portion 900B. A registration sensor 108 is disposed on the upstream of the registration roller 107 in the sheet feeding direction and detects a sheet S conveyed from the pull-out roller 106.

Next, an image forming operation performed by the image forming apparatus 900 configured in this way will be described. When the image forming operation is started, first, the exposure apparatus 906 radiates a laser beam based on image information supplied from a PC or the like not illustrated in the figure and sequentially exposes the surfaces of the photosensitive drums a to d of which the surfaces are uniformly charged with a predetermined polarity at predetermined electric potential, thereby forming electrostatic latent images on the photosensitive drums a to d. Thereafter, these electrostatic latent images are developed using toner so as to be visualized.

For example, first, a laser beam according to an image signal of a yellow component color of an original is irradiated on the photosensitive drum a through a polygon mirror of the exposure apparatus 906 or the like, whereby a yellow electrostatic latent image is formed on the photosensitive drum a. Then, this yellow electrostatic latent image is developed by using yellow toner supplied from the development device, thereby being visualized as a yellow toner image. Thereafter, the toner image arrives at the primary transfer portion at which the photosensitive drum a and the intermediate transfer belt 902 abut each other in accordance with the rotation of the photosensitive drum a. Here, when the toner image arrives at the primary transfer portion in this way, the yellow toner image formed on the photosensitive drum a is transferred to the intermediate transfer belt 902 in accordance with a primary transfer bias applied to the transfer charger 902*a* (primary transfer).

Next, when a portion of the intermediate transfer belt 902 that carries the yellow toner image moves, a magenta toner image formed on the photosensitive drum b using a method similar to that described above by this time is transferred to the intermediate transfer belt 902 on the yellow toner image. Similarly, as the intermediate transfer belt 902 moves, a cyan toner image and a black toner image are transferred to overlap the yellow toner image and the magenta toner image by the primary transfer portion. Accordingly, a full-color toner image is formed on the intermediate transfer belt 902.

In parallel with this toner image forming operation, sheets P housed in the sheet feeding cassette 904 are fed by the pickup roller 908 one by one and then are conveyed toward the registration roller 107. In addition, at the time of manual sheet feeding, sheets S set in the manual tray 105 that is a sheet stacking portion are fed by a feed roller 101 and then are separated one by one by a separation portion that is configured by a feed roller 102 and a separation roller 103. Then, the separated sheet is conveyed toward the registration roller 107.

Then, the sheet P fed by the pickup roller 908 or the feed roller 101 is detected by the registration sensor 108 and then, arrives at the registration roller 107 that is in a stopped state. Thereafter, the sheet is conveyed to the secondary transfer portion 903 by the registration roller 107 that is rotated at predetermined timing. Thereafter, in this secondary transfer portion 903, toner images of four colors that are formed on the intermediate transfer belt 902 are transferred onto the sheet P together in accordance with a secondary transfer bias applied to the secondary transfer roller 903*a* that is a transfer portion (secondary transfer).

Next, the sheet P onto which the toner images are transferred is conveyed to a fixing portion 905 from the secondary transfer portion 903 with being guided by a conveyance guide 920 and, when passing the fixing portion 905, receives heat and pressure so as to cause the toner images to be fixed. Thereafter, the sheet P on which the toner images have been fixed in this way passes through a discharge path 921 disposed on the downstream of the fixing portion 905, then is discharged by a pair of discharge rollers 922, and is conveyed to the finisher 909. Then, after predetermined processing is performed for the sheet by the finisher 909, the processed sheet is discharged to a sheet discharging tray 114.

Figure 2:
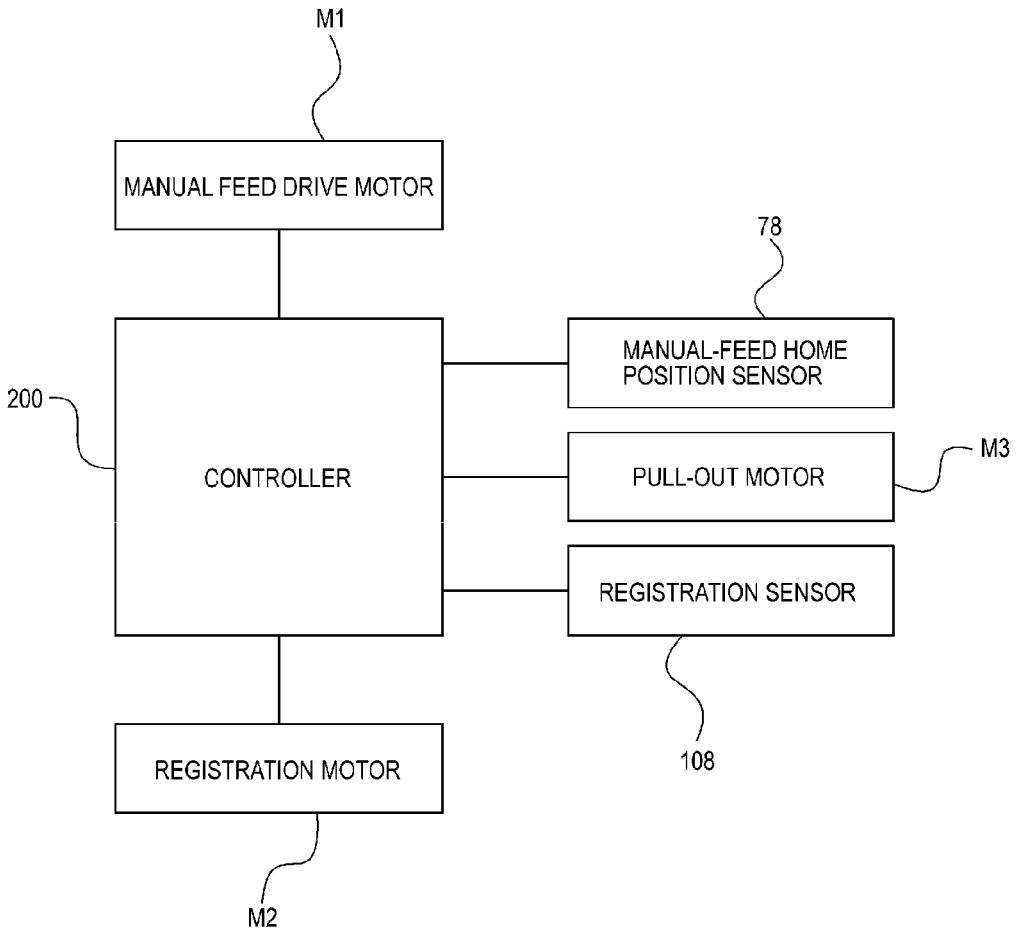
FIG. 2 is a control block diagram of the image forming apparatus described above.

FIG. 2 is a control block diagram of the image forming apparatus 900 according to this embodiment. As illustrated in FIG. 2, a manual feed drive motor M1 that drives a feed roller 101, the feed roller 102, and the separation roller 103 and a registration motor M2 that drives the registration roller 107 are connected to the controller 200. In addition, a pull-out motor M3 that drives the pull-out roller 106, the registration sensor 108, and a manual-feed home position sensor 78 to be described later are connected to the controller 200.

Figure 3:
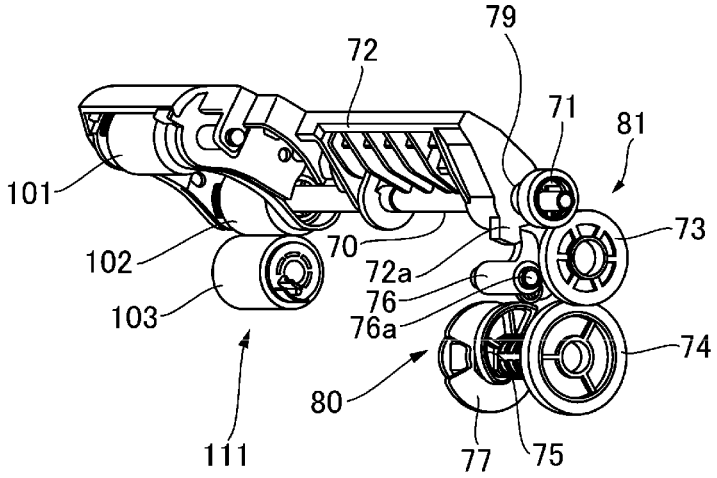
FIG. 3 is a diagram that illustrates the configuration of a manual feed portion disposed in a manual sheet feeding unit as the sheet feeding device described above.

FIG. 3 is a diagram that illustrates the configuration of the manual feed portion 111 disposed in the manual sheet feeding unit 110. The manual feed portion 111 includes a feed roller 101, a feed roller 102, and a separation roller 103 that form a sheet feeding portion feeding the sheet S, which is set (stacked) in the above-described manual tray 105, by abutting the sheet from the upper side to be separably in contact therewith. The feed roller 101 and the feed roller 102 are connected to each other by a gear not illustrated in the figure so as to be driven by the manual feed drive motor M1 illustrated in FIG. 2. In addition, the separation roller 103 is connected to the manual feed drive motor M1 illustrated in FIG. 2 through a torque limiter not illustrated in the figure.

In FIG. 3, a drive shaft 70 to which the feed roller 102 is attached and a drive gear 71 used for transferring the driving of the manual feed drive motor M1 to the drive shaft 70 are illustrated. This drive gear 71 includes a one-way clutch on the inside thereof, and the drive gear 71 rotates only in a direction in which a sheet is fed by the one-way clutch. In addition, a holding frame 72 is a support member that supports the feed roller 101 to be rotatable and is freely rotatable in the vertical direction about the drive shaft 70 being used as its center. This holding frame 72 is biased in a direction in which the feed roller 101 abuts the sheet S by a bias spring (torsion coil spring) 79 as a biasing unit that is arranged between the main body frame not illustrated in the figure and the holding frame 72.

In addition, a cam driving gear 74 is connected to the drive gear 71 through an idler gear 73, and a cam 75 rotating the holding frame 72 in the vertical direction is integrally attached to the cam driving gear 74. Thus, when the cam driving gear 74 rotates, the cam 75 is rotated as well. Furthermore, a cam follower 76 is disposed between the cam 75 and the holding frame 72, and this cam follower 76 is brought into contact slidably with the peripheral face of the rotating cam 75 and rotates using a shaft 76*a* as a supporting point so as to press a pressing portion 72*a* disposed in the holding frame 72.

Accordingly, the holding frame 72 upwardly rotates. In addition, when the pressing of the pressing portion 72*a* according to the cam follower 76 is released, the holding frame 72 is downwardly rotated by the biasing spring 79. In this way, in this embodiment, the cam 75 and the cam follower 76 configure a lifting and lowering mechanism 80 that lifts or lowers the feed roller 101. According to the lifting and lowering of the holding frame 72 using the lifting and lowering mechanism 80, the feed roller 101 is also lifted or lowered. Thus, the feed roller 101 abuts a sheet S that is stacked in the manual tray 105 at a position of the lower side of the feed roller 101 and is separated from the sheet S at a position of the upper side of the feed roller 101. In addition, by the drive gear 71, the idler gear 73, and the cam driving gear 74, a drive transfer portion 81 that transfers the rotation of the manual feed drive motor M1, which is a motor rotating the cam 75, to the cam 75 is configured.

Figure 4:
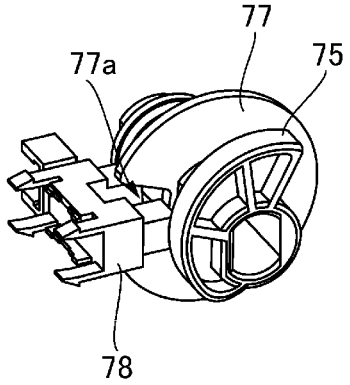
FIG. 4 is a diagram that illustrates a manual-feed home position sensor disposed in the manual sheet feeding unit described above.

Here, the angle position of the cam 75, as illustrated in FIG. 4, is fixed to the cam 75 on the same axis as that of the cam 75 and is detected by using an HP sensor flag 77 in which a slit 77*a* is formed and the manual-feed home position sensor 78 disposed in a frame not illustrated in the figure. Then, based on a signal output from the manual-feed home position sensor 78, the controller 200 rotates the manual feed drive motor M1 until the cam 75 is moved to an initial position at which the feed roller 101 is held at a standby position to be described later. In addition, a first detection portion is configured by the controller 200 and the manual-feed home position sensor 78, and, based on a signal supplied from the manual-feed home position sensor 78, the controller 200 controls the manual feed drive motor M1, thereby moving the feed roller 101 to the standby position.

Figure 5A:
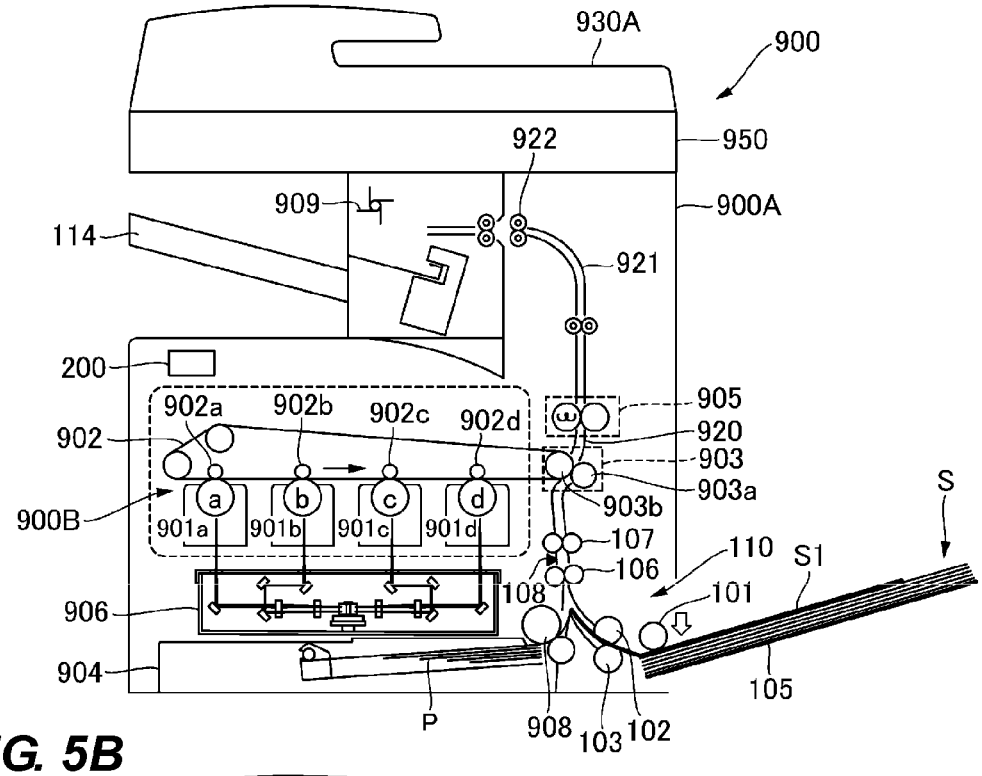
FIGS. 5A and 5B are diagrams that illustrate a conventional sheet feeding operation of the manual sheet feeding unit described above.
Figure 5B:
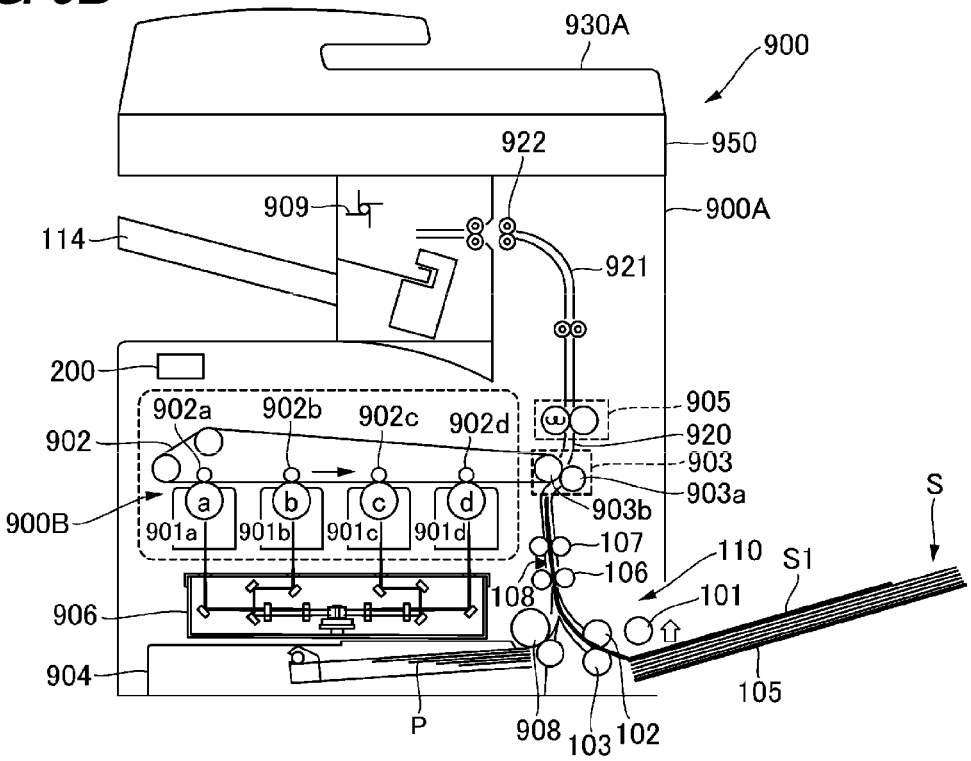

FIGS. 5A and 5B are diagrams that illustrate a sheet feeding operation of the manual sheet feeding unit 110 according to this embodiment. FIG. 1 described above represents a state before the designation of manual sheet feeding, and, at this time, as a state before the start of the sheet feeding operation, the feed roller 101 is separated from a sheet S stacked into the manual tray 105. A position of the upper side of the sheet S of the feed roller 101 is the standby position. In addition, the position (state) of the cam 75 in the rotation direction at the time of locating the feed roller 101 at the standby position is set as the initial position (home position).

When the feeding operation is started, driving is input to the drive gear 71 from the manual feed drive motor M1, and the feed roller 101 and the cam 75 rotate. Then, the feed roller 101 is lowered to move to a feeding position abutting an uppermost sheet in accordance with the rotation of the cam 75, feeds the uppermost sheet, and feeds the uppermost sheet to the separation portion that is configured by the feed roller 102 and the separation roller 103. Here, the feeding position of the feed roller 101 is a position abutting an upper face of the sheet stacked in the manual tray 105, and the position in the vertical direction is different in accordance with the stacking amount of sheets. The feed roller 101 is abutted to the upper face of the stacked sheet with constant pressure (sheet feeding pressure) by the biasing spring 79, thereby feeding the sheet when the feed roller 101 rotates.

Sheets fed to the separation portion are separated one by one by the separation portion, and each separated sheet, as illustrated in FIG. 5A, is conveyed to the registration roller 107 by the pull-out roller 106. Here, when a sheet is fed, there are cases where the feed roller 101 slips with respect to the sheet, and, when a sheet is separated, there are cases where the feed roller 102 slips with respect to the sheet. In consideration of this, in this embodiment, the manual feed drive motor M1 is set to be driven until the sheet arrives at the registration roller 107. Accordingly, in accordance with the sheet feeding operation of the sheet feeding device that is performed once, the sheet is conveyed up to the registration roller 107.

In addition, in a case where a sheet is conveyed by the sheet feeding operation performed once in this way, the registration sensor 108 positioned on the downstream side of the feed roller 101 in the sheet feeding direction is set to detect a sheet S before the manual feed drive motor M1 stops. Then, when a predetermined time elapses after a detection signal supplied from the registration sensor 108 is received, the controller 200 temporarily stops the pull-out motor M3 and the manual feed drive motor M1. Hereinafter, the temporary stop of the pull-out motor M3 and the manual feed drive motor M1 as above will be referred to as a temporary stop. Here, a second detection portion is configured by the controller 200 and the registration sensor 108 and receives a signal supplied from the registration sensor 108, and the controller 200 detects a conveyed sheet arriving at the registration roller 107.

Figure 6:
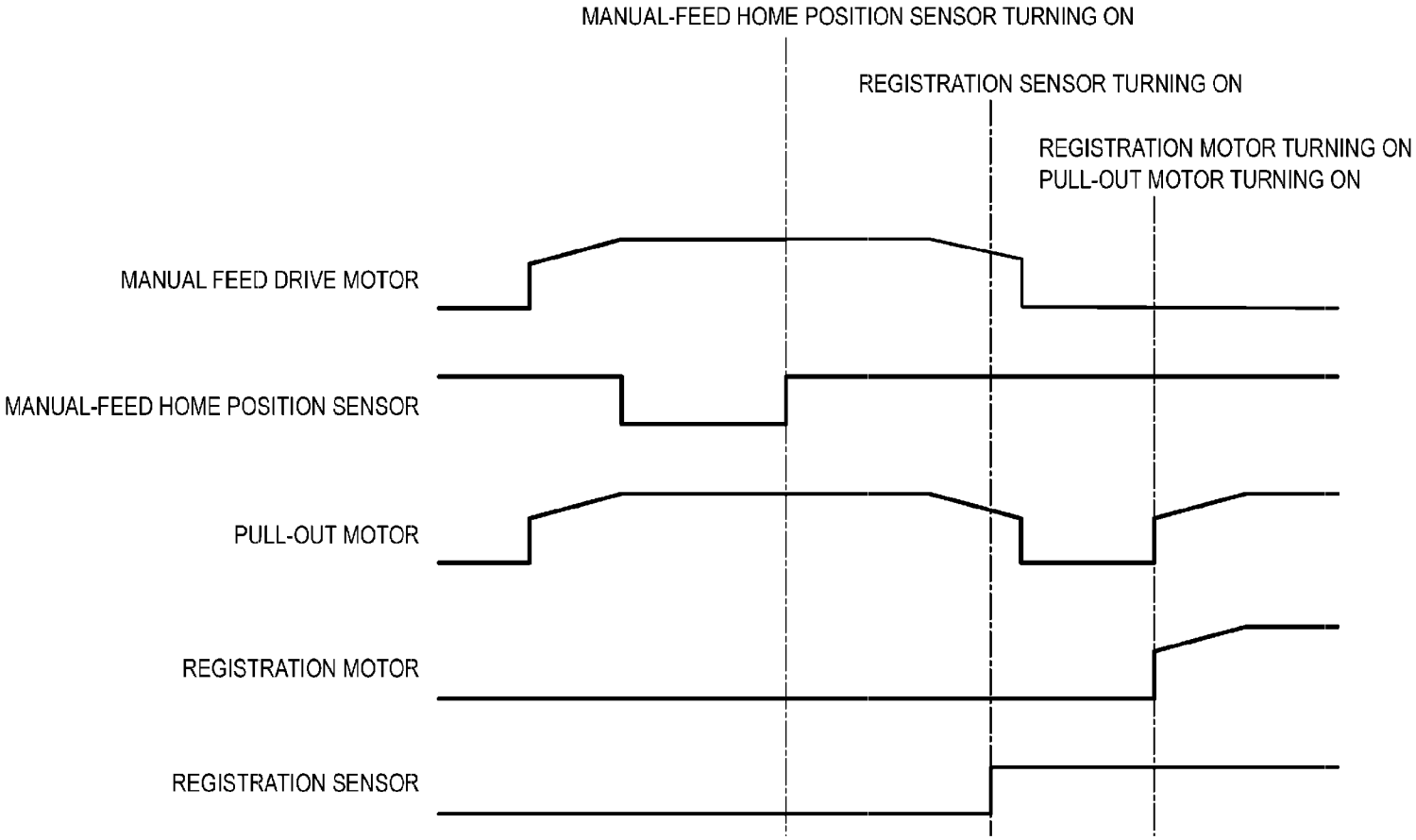
FIG. 6 is a timing chart that illustrates a conventional sheet feeding operation of the manual sheet feeding unit described above.

In this state, the sheet is stopped in a state in which the front end (the downstream end in the sheet feeding direction) abuts the registration roller 107 that is in the stopped state to form a loop and correct skew feeding, and it is considered that the sheet front end position is positioned. Thereafter, the registration motor M2 is driven at predetermined timing, the driving of the pull-out motor M3 and the manual feed drive motor M1 is restarted in synchronization therewith, and, as illustrated in FIG. 5B, the sheet S is conveyed to the image forming portion 900B. FIG. 6 is a timing chart that illustrates this operation timing.

Figure 7A:
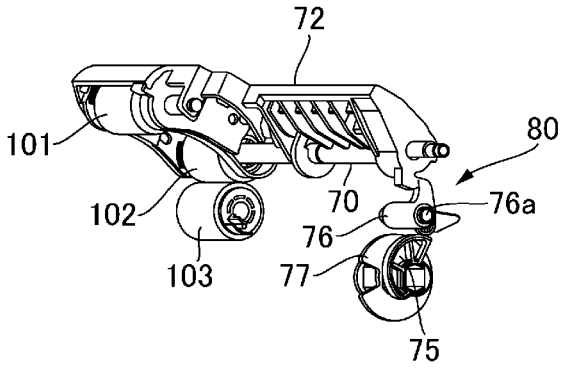
FIGS. 7A to 7C are diagrams that illustrate a feed roller lifting and lowering operation performed by a lifting and lowering mechanism of the manual sheet feeding unit described above.
Figure 7B:
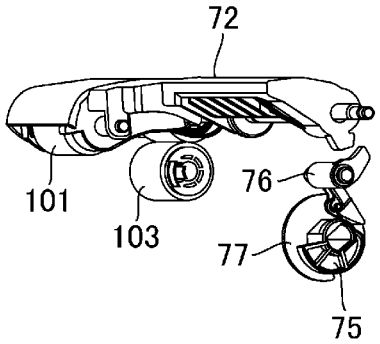

Next, the lifting and lowering operation of the feed roller 101 performed by the lifting and lowering mechanism 80 during the sheet feeding operation performed by the sheet feeding device will be described with reference to FIGS. 7A to 7C. FIG. 7A illustrates a standby state before the sheet feeding operation in which the feed roller 101 is located at the standby position. At this time, one end of the cam follower 76 is lifted by the cam 75, and the cam follower 76 rotates about the shaft 76*a* of the cam follower 76 as the center and pushes the end portion of the holding frame 72. In this way, the holding frame 72 supports the feed roller 101 at a position separated toward the upper side of the sheet against the elastic force of the biasing spring 79.

Thereafter, when the controller 200 receives a sheet feeding signal from the apparatus main body 900A, the manual feed drive motor M1 is driven, the feed roller 101 and the feed roller 102 rotate through the drive shaft 70, and the cam 75 rotates through the idler gear 73 and the cam driving gear 74. In this way, the supporting of the holding frame 72 is released by rotating the cam follower 76, and, as illustrated in FIG. 7B, the holding frame 72 is lowered by the biasing spring 79 to the feeding position at which the feed roller 101 abuts the uppermost sheet.

Figure 7C:
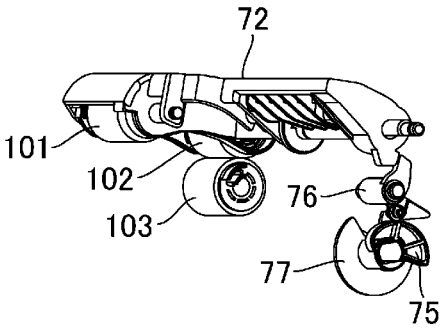

Thereafter, a sheet feeding operation is performed by the feed roller 101 that is rotating, and, in accordance with the rotation of the cam 75 accompanied with the feeding operation, the cam follower 76 rotates to press the end portion of the holding frame 72 and, as illustrated in FIG. 7C, lifts the holding frame 72. Then, after the manual-feed home position sensor 78 detects an edge of the slit 77*a* of the HP sensor flag 77, the cam 75 is rotated by a predetermined angle, and then, the sheet feeding operation for feeding one sheet ends. In this way, the feed roller 101 is returned to the standby position illustrated in FIG. 7A, and the cam 75 is returned to the initial position (home position) illustrated in FIG. 8.

As above, the cam 75 is rotated once during the sheet feeding operation performed once, and while the cam 75 is rotated once, the feed roller 101 feeds the sheet by a predetermined distance by moving from the standby position to the feeding position in accordance with the rotation angle of the cam 75 and then is returned to the standby position. In this case, since a time during which the feed roller 101 abuts the upper face of the sheet stacked in the feed roller 101 when the cam 75 is rotated once is approximately constant, a feed distance (the feeding amount of a sheet) of the fed sheet is approximately constant.

In such a manual feed portion 111, as described above, there are cases where the feed roller 101 or the feed roller 102 slips with respect to the sheet. When a slip occurs, one rotation of the cam 75 ends in a state in which the front end of the sheet does not arrive at the pull-out roller 106, and accordingly, a no-feed jam is formed. For this reason, in this embodiment, as described above, at the time of performing the sheet feeding operation once, the feeding distance of the sheet according to the feed roller 101 is set to have a margin so as to convey the sheet until the sheet arrives at the registration roller 107. In addition, in order to feed the sheet in this way, by appropriately setting the gear ratio of the drive gear 71, the idler gear 73, and the cam driving gear 74, when the cam 75 rotates once, the sheet is conveyed by a distance exceeding the registration roller 107.

As in this embodiment, in a case where a sheet is conveyed according to the control of one rotation of the cam 75, in a case where the cam 75 cannot be stopped at the initial position, a deviation of the sheet feeding timing occurs at the time of feeding the next sheet, and there are cases where a problem such as no feeding may occur. For this reason, after the manual-feed home position sensor 78 detects the edge of the slit 77*a* of the HP sensor flag 77, after the cam 75 is rotated by a predetermined angle, the manual feed drive motor M1 needs to be stopped.

However, the rotation angle of the cam 75 at the time of detecting a sheet by using the registration sensor 108 is different for each time in accordance with the degree of a slip occurring between each roller and the sheet. Here, for example, in a case where the manual feed drive motor M1 is a stepping motor, when direct deceleration is performed in the acceleration state of the motor, a deviation of a drive step, so-called "out of step" occurs, and accordingly, a calming section of about 50 ms in which the speed is maintained to be constant during the deceleration process from acceleration, for example, is necessary.

As described above, when the manual feed drive motor M1 is restarted after being temporarily stopped, there are cases where the edge of the HP sensor flag 77 is detected by the manual-feed home position sensor 78 simultaneously with the restarting depending on the rotation angle of the cam 75. In such cases, the calming section cannot be secured, and the cam 75 cannot be stopped at the initial position. Thus, in this embodiment, the manual feed drive motor M1 is driven by performing a different control process, in other words, acceleration/deceleration control or constant speed control according to the rotation angle of the cam 75 at the time of temporarily stopping the manual feed drive motor M1.

Figure 8:
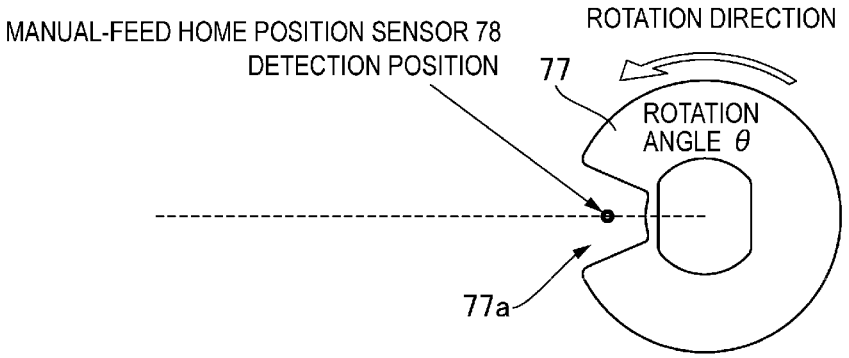
FIG. 8 is a diagram that illustrates a positional relation between a manual-feed home position sensor of the manual sheet feeding unit and an HP sensor flag.

FIG. 8 is a diagram that illustrates a positional relation between the manual-feed home position sensor 78 and the HP sensor flag 77 and illustrates the HP sensor flag 77 and the detection position of the manual-feed home position sensor 78 when the cam 75 is stopped at the correct initial position. Hereinafter, the rotation angle of the cam 75, which is detected by the manual-feed home position sensor 78, is assumed to be 0° when cam 75 is located at the initial position, and the rotation angle of the cam 75 is assumed to be θ (°) when the cam 75 is rotated by the manual feed drive motor M1.

Here, as described above, in this embodiment, since the sheet S is conveyed by a distance exceeding the registration roller 107 in a case where the cam 75 is rotated once, it is necessary to stop and restart the manual feed drive motor M1 during one rotation)(360°) of the cam 75. In addition, in order to accelerate/decelerate/stop the manual feed drive motor M1 after being started up, there are restrictions on an acceleration/deceleration time, a calming time, and the like.

For example, when the self-activation frequency of the manual feed drive motor M1 is 250 pps, the operating frequency is 500 pps, the acceleration/deceleration is 10 pps/ms, and the calming time is 50 ms, the acceleration/deceleration time is 25 ms. In other words, a required time of the manual feed drive motor M1 until acceleration up to constant-speed rotation from a stopped state and until deceleration from the constant-speed rotation and stop after the deceleration is 100 ms. In this case, in order to accelerate/calm/decelerate/stop the manual feed drive motor M1, it is necessary to drive the manual feed drive motor M1 for a total of 44 pls. When the rotation angle near 1 pls of the manual feed drive motor M1 is 7.5°, 44 pls corresponds to a rotation angle of 330° of the rotation shaft of the manual feed drive motor M1.

Here, when the manual feed drive motor M1 rotates by a rotation angle (330° described above) of the manual feed drive motor M1 required for the acceleration/calming/deceleration/stop, the angle of the rotation of the cam 75 is set as a minimal acceleration operation angle γ (°) of the cam. The minimal acceleration operation angle γ (°) that is this rotation angle depends on a speed reduction ratio of a drive train from the manual feed drive motor M1 to the cam 75. In other words, in this embodiment, the manual feed drive motor M1 rotates by 330° at 44 pls, and the cam 75 rotates by a rotation angle γ in accordance with the reduction ratio of the drive train when the manual feed drive motor M1 rotates by 330°.

When a sheet is fed, the controller 200 starts up/accelerates the manual feed drive motor M1 when the phase of the cam 75 is 0°, causes the manual feed drive motor M1 to pass through a steady state, and decelerates/stops the manual feed drive motor M1 by being triggered upon the detection of the sheet front end using the registration sensor 108. At this time, as described above, since dispersion of the conveyance amount (feeding amount) of the sheet, occurs due to a slip between the sheet and the feed roller 102, the rotation angle θ of the cam 75 is not constant when the manual feed drive motor M1 stops. Thus, the rotation angle θ of the cam 75 at the time of temporary stop when the front end of the sheet arrives at the registration roller 107, and the manual feed drive motor M1 temporarily stops is unknown.

However, the rotation angle θ of the cam 75 at the time of the temporary stop of the manual feed drive motor M1 can be detected by accumulatively adding up the rotation angular velocity of the manual feed drive motor M1, in other words, the number of pulses until the temporary stop after the starting of the sheet feeding operation. For this reason, the manual feed drive motor M1 is restarted after being temporarily stopped, and, after the HP sensor flag 77 is detected by using the manual-feed home position sensor 78, the cam 75 is rotated by "360−θ", whereby the cam 75 can be stopped at the initial position.

Figure 9A:
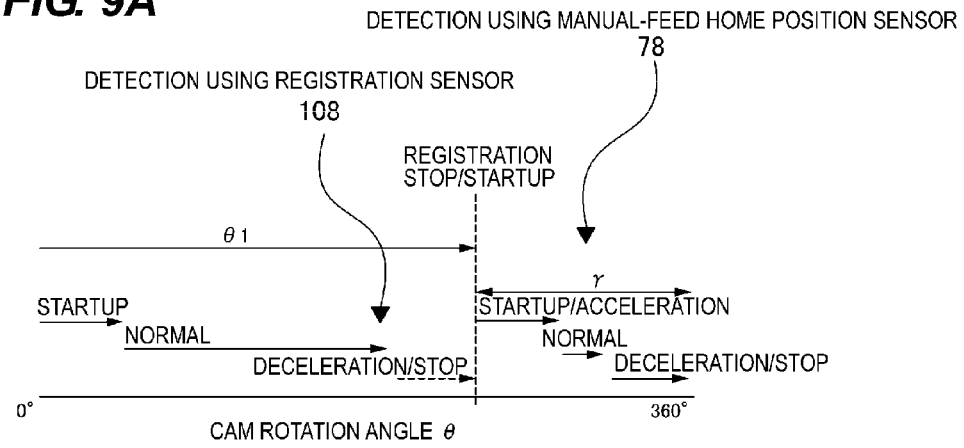
FIGS. 9A to 9C are diagrams that illustrate a rotation angle of a cam of the manual sheet feeding unit and a drive operation of a manual feed drive motor.

FIG. 9A illustrates the rotation angle θ of the cam 75 and the drive operation of the manual feed drive motor M1 in a case where a sheet is fed without any slip and any delay. At this time, the rotation angle of the cam 75 at the temporary stop of the manual feed drive motor M1 that is calculated by the controller 200 based on the number of pulses applied to the manual feed drive motor M1 is θ1. In this case, since θ1<360−γ, the manual feed drive motor is started up and accelerated in synchronization with the start-up of the registration, and the manual feed drive motor is started up/accelerated, is in a steady state, and is decelerated/stopped with reference to the detection of the edge of the HP sensor flag 77 using the manual-feed home position sensor 78. By performing such acceleration/deceleration control, the manual feed drive motor M1 is driven at an operating frequency and is rotated at a first speed, and accordingly, the cam 75 can be stopped at the initial position.

Figure 9B:
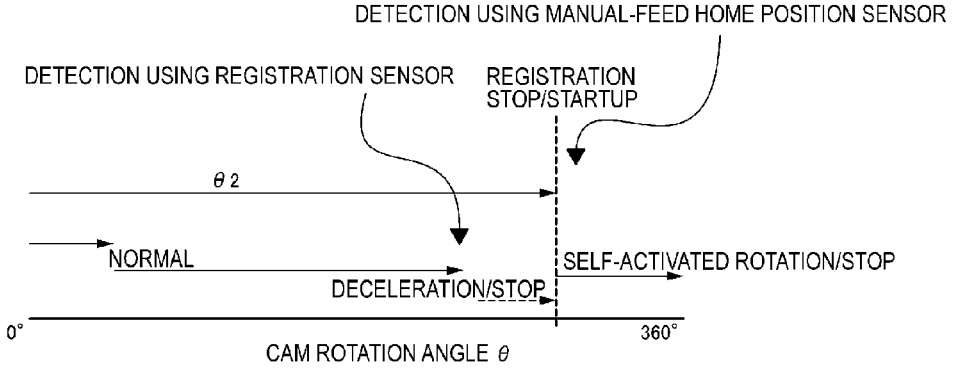

FIG. 9B illustrates the rotation angle of the cam 75 and the drive operation of the manual feed drive motor in a case where a sheet is fed with a slight delay due to a slip. In this case, the rotation angle of the cam 75 at the temporary stop of the manual feed drive motor M1 is θ2, and θ2 is larger than θ1 illustrated in FIG. 9A in correspondence with the delay of the sheet, and accordingly, θ2>360−γ. In this case, by starting up and accelerating the manual feed drive motor M1 at the time of start-up of the registration, in other words, by controlling the acceleration/deceleration, the cam 75 cannot be stopped at the correct initial position. Thus, in the case of θ2>360−γ, in this embodiment, the manual feed drive motor is driven at the self-activation rotation number at the time of the start-up of the registration so as to be rotated at a second speed lower than the first speed. Accordingly, the restrictions of the acceleration and the calming time are released, and the cam 75 can be stopped at the initial position with reference to the detection of the edge of the HP sensor flag 77 using the manual-feed home position sensor 78.

Figure 9C:
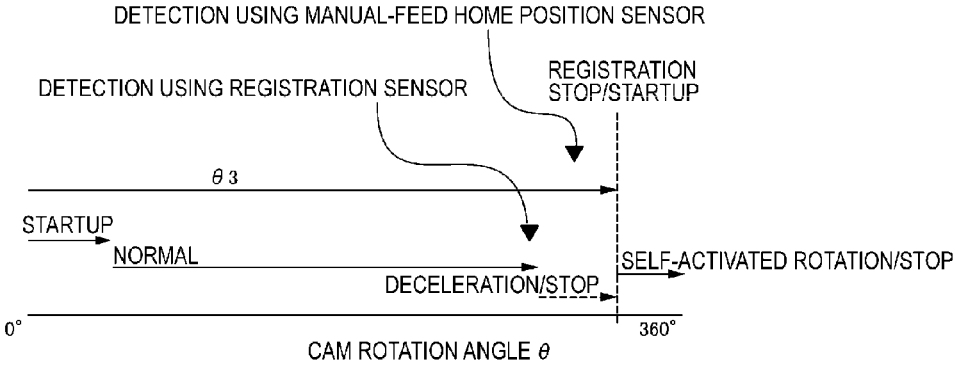

FIG. 9C illustrates the rotation angle of the cam 75 and the drive operation of the manual feed drive motor in a case where a sheet is fed with a delay longer than that of the case illustrated in FIG. 9B. In this case, the rotation angle of the cam 75 at the temporary stop of the manual feed drive motor M1 is θ3, and θ3 is larger than θ2 illustrated in FIG. 9B in correspondence with the further delay of the sheet, and accordingly, θ3>360−γ. In this case, since the cam 75 cannot be stopped at the initial position after the start-up/acceleration of the manual feed drive motor M1 at the time of start-up of the registration, the manual feed drive motor is driven at the self-activation rotation number at the time of the start-up of the registration so as to be rotated at the second speed. By performing such constant-speed control, the cam 75 can be stopped at the initial position.

In the case of FIG. 9C, the edge of the HP sensor flag 77 is detected by using the manual-feed home position sensor 78 before the temporary stop of the manual feed drive motor M1. Also in this case, by managing the rotation angle of the cam based on the detection of the edge of the HP sensor flag 77 using the manual-feed home position sensor 78, the cam 75 can be stopped at the initial position.

As described above, in this embodiment, in the case of θ<360−γ, the controller 200 rotates the manual feed drive motor M1 at the first speed by controlling the acceleration/deceleration thereof until the cam 75 arrives at the initial position and stops the manual feed drive motor M1 based on a signal supplied from the manual-feed home position sensor 78. On the other hand, in the case of θ>360−γ, the controller 200 rotates the manual feed drive motor M1 at the constant second speed lower than the first speed until the cam 75 arrives at the initial position and stops the manual feed drive motor M1 based on a signal supplied from the manual-feed home position sensor 78. Accordingly, after a sheet is fed, the cam 75 can be reliably stopped at the initial position, and thus, space saving and low cost can be achieved, whereby the sheet can be fed in a reliable manner.

In addition, in this embodiment, while the stepping motor is used as the manual feed drive motor M1, and thus, the self-activation at the time of restart-up of the manual feed drive motor M1 has been defined, a DC brushless motor may be employed as the manual feed drive motor M1. In the case of the DC brushless motor, while the setting of the calming time in the motor control process described in this embodiment is not necessary, an overrun due to inertia occurs. Thus, in a case where the DC brushless motor is used, in the state illustrated in FIG. 9A described above, for example, the DC brushless motor is used at 3000 rpm that is the first speed, and acceleration/deceleration control is performed. In addition, in the case of the constant-speed operation as illustrated in FIGS. 9B and 9C, the DC brushless motor is used at about 1000 rpm that is the second speed, a time required for the acceleration/deceleration process is minimized, and the amount of the overrun due to motor inertia is decreased. In this way, advantages similar to those in a case where the manual feed drive motor M1 is used can be acquired.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-044645, filed Mar. 7, 2014, which is hereby incorporated by reference herein in its entirety.

What is claimed is:

1. A sheet feeding device comprising:

a sheet stacking portion on which sheets are stacked;

a sheet feeding portion which abuts and feeds an uppermost sheet stacked in the sheet stacking portion;

a support member which supports the sheet feeding portion and is rotatable in a vertical direction;

a cam which holds the sheet feeding portion at a standby position separated from the uppermost sheet by upwardly rotating the support member and moves the sheet feeding portion to a feeding position abutting the uppermost sheet by downwardly rotating the support member;

a motor which rotates the cam;

a first detection portion which detects that the cam is located at an initial position holding the sheet feeding portion at the standby position;

a registration portion which is arranged downstream of the sheet feeding portion in a sheet feeding direction, abuts a downstream end of the sheet fed by the sheet feeding portion in the sheet feeding direction in a stopped state, and feeds the sheet by being rotated at predetermined timing;

a drive transfer portion which is set such that the sheet fed by the sheet feeding portion at the feeding position arrives at the registration portion by lifting and lowering the sheet feeding portion between the standby position and the feeding position in accordance with one rotation of the cam by the motor;

a second detection portion which is disposed on an upstream side of the registration portion in the sheet feeding direction and detects when the sheet fed by the sheet feeding portion arrives at the registration portion; and a controller which stops the motor according to a detection result by the second detection portion and then performs a rotation control so as to rotate the motor again and to stop the motor according to a detection by the first detection portion, wherein when the rotation control is performed, the controller changes a rotating speed of the motor to a first speed or to a second speed which is smaller than the first speed according to a rotation angle $\theta$, the rotation angle $\theta$ being a rotation angle of the cam formed in relation to the initial position when the controller stops the motor according to the detection result by the second detection portion, and wherein a rotation angle when the rotation control is performed at the first speed is larger than a rotation angle when the rotation control is performed at the second speed.

2. The sheet feeding device according to claim 1, further comprising:

a registration motor which drives the registration portion, wherein the controller temporarily stops the motor and then simultaneously drives the motor and the registration motor based on a signal from the second detection portion.

3. The sheet feeding device according to claim 1, wherein the motor is a stepping motor, and the controller calculates the rotation angle $\theta$ of the cam at the time of stopping the motor based on the number of pulses applied to the motor until the motor stops.

4. The sheet feeding device according to claim 3, wherein the second speed is a speed at the time of driving the motor at a self-activation frequency.

5. The sheet feeding device according to claim 3, wherein the first speed is a speed when the motor rotates at a frequency exceeding a self-activation frequency.

6. The sheet feeding device according to claim 1, wherein rotation used for feeding the sheet is transferred from the motor to the sheet feeding portion by the drive transfer portion.

7. The sheet feeding device according to claim 1, wherein a cam follower that is rotatable with being flexibly brought into contact with the cam between the cam and the support member is arranged, and the support member is pressed to be lifted in accordance with rotation of the cam follower.

8. The sheet feeding device according to claim 1, wherein the first detection portion includes a sensor flag that is fixed to the cam on a same axis as that of the cam and has a slit formed therein and a home position sensor that outputs a signal according to the slit.

9. The sheet feeding device according to claim 1, wherein the motor is a stepping motor and the stepping motor is rotated at the first speed with a frequency larger than a self-activation frequency, and during a start of rotation of the stepping motor from a stopped status until the stepping motor stops again, the controller controls so that:

the motor rotates at the first speed in a case that $\theta<360-\gamma$, and the motor rotates at the second speed in a case that $\theta>360-\gamma$, where $\gamma$ is a minimum rotation angle of the cam.

10. An image forming apparatus comprising:

an image forming portion which forms an image on a sheet; and a sheet feeding device which feeds the sheet to the image forming portion, the sheet feeding device including:

a sheet stacking portion on which the sheets are stacked;

a sheet feeding portion which abuts and feeds an uppermost sheet stacked in the sheet stacking portion;

a support member which supports the sheet feeding portion and is rotatable in a vertical direction;

a cam which holds the sheet feeding portion at a standby position separated from the uppermost sheet by upwardly rotating the support member and moves the sheet feeding portion to a feeding position abutting the uppermost sheet by downwardly rotating the support member;

a motor which rotates the cam;

a first detection portion which detects that the cam is located at an initial position holding the sheet feeding portion at the standby position;

a registration portion which is arranged downstream of the sheet feeding portion in a sheet feeding direction, abuts a downstream end of the sheet fed by the sheet feeding portion in the sheet feeding direction in a stopped state, and feeds the sheet by being rotated at predetermined timing;

a drive transfer portion which is set such that the sheet fed by the sheet feeding portion at the feeding position arrives at the registration portion by lifting and lowering the sheet feeding portion between the standby position and the feeding position in accordance with one rotation of the cam by the motor;

a second detection portion which is disposed on an upstream side of the registration portion in the sheet feeding direction and detects when the sheet fed by the sheet feeding portion arrives at the registration portion; and a controller which stops the motor according to a detection result by the second detection portion and then performs a rotation control so as to rotate the motor again and to stop the motor according to a detection by the first detection portion, wherein when the rotation control is performed, the controller changes a rotating speed of the motor to a first speed or to a second speed which is smaller than the first speed according to a rotation angle θ, the rotation angle θ being a rotation angle of the cam formed in relation to the initial position when the controller stops the motor according to the detection result by the second detection portion, and wherein a rotation angle when the rotation control is performed at the first speed is larger than a rotation angle when the rotation control is performed at the second speed.

11. The image forming apparatus according to claim 10, further comprising:

a registration motor which drives the registration portion, wherein the controller temporarily stops the motor and then simultaneously drives the motor and the registration motor based on a signal from the second detection portion.

12. The image forming apparatus according to claim 10, wherein the motor is a stepping motor, and the controller calculates the rotation angle θ of the cam at the time of stopping the motor based on the number of pulses applied to the motor until the motor stops.

13. The image forming apparatus according to claim 12, wherein the second speed is a speed at the time of driving the motor at a self-activation frequency.

14. The image forming apparatus according to claim 12, wherein the first speed is a speed when the motor rotates at a frequency exceeding a self-activation frequency.

15. The image forming apparatus according to claim 10, wherein rotation used for feeding the sheet is transferred from the motor to the sheet feeding portion by the drive transfer portion.

16. The image forming apparatus according to claim 10, wherein a cam follower that is rotatable with being flexibly brought into contact with the cam between the cam and the support member is arranged, and the support member is pressed to be lifted in accordance with rotation of the cam follower.

17. The image forming apparatus according to claim 10, wherein the first detection portion includes a sensor flag that is fixed to the cam on a same axis as that of the cam and has a slit formed therein and a home position sensor that outputs a signal according to the slit.

18. The image forming apparatus according to claim 10, wherein the motor is a stepping motor and the stepping motor is rotated at the first speed with a frequency larger than a self-activation frequency, and during a start of rotation of the stepping motor from a stopped status until the stepping motor stops again, the controller controls so that:

the motor rotates at the first speed in a case that $\theta<360-\gamma$, and the motor rotates at the second speed in a case that $\theta>360-\gamma$, where γ is a minimum rotation angle of the cam.

* * * * *